US006122911A

United States Patent [19]

Maeda et al.

[11] Patent Number: 6,122,911

[45] Date of Patent: Sep. 26, 2000

[54] EXHAUST MANIFOLD PIPE WELD ASSEMBLY

[75] Inventors: Fumihiko Maeda, Minamika wachi-machi, Japan; Ryan S. Chapman, Columbus, Ohio

[73] Assignee: Honda Giken Kogyo Kabushiki Kaisha, Tokyo, Japan

[21] Appl. No.: 09/161,652

[22] Filed: Sep. 28, 1998

[51] Int. Cl.[7] ..... F01N 7/10

[52] U.S. Cl. ..... 60/323; 60/322; 60/282; 285/131.1; 285/132.1

[58] Field of Search ..... 60/323, 313, 272, 60/322, 282; 285/150, 152, 155, 130.1, 131.1, 132.1

[56] References Cited

U.S. PATENT DOCUMENTS

| | | | |
|---|---|---|---|
| 4,022,019 | 5/1977 | Garcea . | |
| 4,182,121 | 1/1980 | Hall . | |
| 4,621,494 | 11/1986 | Fujita . | |
| 4,796,426 | 1/1989 | Feuling . | |
| 4,815,274 | 3/1989 | Piatti . | |
| 5,216,883 | 6/1993 | Flugger | 60/313 |
| 5,248,859 | 9/1993 | Borla | 181/238 |
| 5,299,419 | 4/1994 | Bittle et al. | 60/313 |
| 5,390,494 | 2/1995 | Cleg . | |
| 5,636,515 | 6/1997 | Matsumoto et al. . | |
| 5,655,362 | 8/1997 | Kawajiri et al. . | |
| 5,726,397 | 3/1998 | Mukai et al. . | |
| 5,727,386 | 3/1998 | Watanabe et al. | 60/323 |
| 5,761,905 | 6/1998 | Yamada et al. . | |
| 5,799,395 | 9/1998 | Nording et al. . | |
| 5,816,044 | 10/1998 | Biggs | 60/313 |
| 5,901,988 | 5/1999 | Aihara et al. | 285/288.1 |

FOREIGN PATENT DOCUMENTS 57-58330 12/1982 Japan .

*Primary Examiner*—Thomas Denion
*Assistant Examiner*—Binh Tran
*Attorney, Agent, or Firm*—Morgan & Finnegan, L.L.P.

[57] ABSTRACT

An exhaust manifold for an internal combustion engine includes one or more pairs of pipe members. Each pipe member has a downstream end portion, and includes along its downstream end portion a side wall in opposing relation with, and concave with respect to, the side wall of the other pipe member of the pair. The pipe members are joined at only two contacting areas of their respective downstream end portions. A gap is defined by the opposing concave side walls in which the side walls expand and contract while heating and cooling. Each of the pair of pipe members includes an outer pipe and an inner pipe disposed within the outer pipe. The inner pipe contacts the outer pipe at three contacting areas that are spaced from each other on the outer pipe so that an air-filled space at least partially separates the inner pipe and the outer pipe. Exhaust gases from the internal combustion engine are conveyed through such pairs of pipe members downstream to one or more exhaust pipes.

22 Claims, 8 Drawing Sheets

EXHAUST MANIFOLD PIPE WELD ASSEMBLY

BACKGROUND OF THE INVENTION

1. Field of the Invention

This invention relates generally to exhaust manifolds, and more particularly to shaping and welding pipe members of an exhaust manifold.

2. Description of the Related Art

Generally, exhaust manifolds for an internal combustion engine include a plurality of discrete pipe members that extend through a flange plate and converge into one or more exhaust pipes. Pairs of adjacent pipe members have side walls that longitudinally abut each other at their downstream ends. The side walls in each abutting pair are welded to each other in order to seal the pipes from any exhaust back flow. Welding the side walls of each pair together adds more lateral support to the pipes and ensures that the pipe members do not rub or hit each other when the engine is running or when the vehicle is moving.

FIG. 1 is an elevational cross-sectional view of a pair of abutting pipe members 10 which extend from an engine in a downstream direction toward an exhaust pipe, as part of an exhaust manifold. Downstream, each of the pair of pipe members has a side wall 12, which is depicted substantially vertical in FIG. 1. In the downstream end portion of the pair 10, the side wall of each pipe member is in confronting relationship with and abuts the other side wall of the pair. This pipe member structure is referred to as a D-shaped pipe member having a D-shaped cross-sectional configuration. Each D-shaped pipe member of the pair of pipe members 10 has a D-shaped cross-sectional configuration that is a mirror image of the other opposite D-shaped pipe member, with the illustrative mirror line being the line of confrontation with the opposing side wall. This pairing of cross-sectional configurations provides an economy of space so that each pair of pipe members 10 of the exhaust manifold can extend directly through an outlet opening 14 in the flange plate 16 into an associated one of a plurality of exhaust pipes. This arrangement eliminates a collector piece that was often required in previous practice to accept engine exhaust gases from the pipe members and convey the exhaust gas downstream to a flange plate or exhaust pipe.

The D-shaped cross-sectional configuration of the pipe member at its downstream end portion (where the pipe members converge) enables the pairs of pipe members to extend directly through the outlet openings in the flange plate into the associated exhaust pipe and eliminates additional collector pieces. However, during operation of the engine, sections of each side wall of the pair of pipe members expand in differing directions along the length of the downstream end portions of the pipe members as illustrated by the horizontal arrows 18 shown in FIG. 1, forming a zigzag pattern of stress (and resultant strain) on the respective side member 12 of each of the pair of pipe members. When the engine is turned off, the side walls of each pair of D-shaped pipe members contract as they cool, often rubbing or sliding against each other as they straighten out in returning to their original position. Such contractions often generate an objectionable "pinging" noise and also wear down the pipe members at these areas, reducing the life of the exhaust manifold. As such, there is currently a need for an exhaust manifold pipe weld assembly which eliminates or reduces these concerns.

SUMMARY OF THE INVENTION

According to an illustrative embodiment of the invention, an exhaust manifold for an internal combustion engine includes one or more pairs of pipe members. Each of the pair of pipe members has a downstream end portion, and includes along the downstream end portion thereof a side wall in opposing relation with, and concave with respect to, the side wall of the other pipe member of the pair. The pipe members are joined at only two contacting areas of their respective downstream end portions. A gap is defined by the opposing concave side walls in which the side walls expand and contract while heating and cooling.

According to an aspect of the invention, each of the pair of pipe members includes an outer pipe and an inner pipe disposed within the outer pipe. Along the downstream end portion of the pipe member, each outer pipe presents a side wall in opposing relation with, and concave with respect to, the side wall presented by the other outer pipe of the pair. The inner pipe contacts the outer pipe at three contacting areas that are spaced from each other on the outer pipe so that an air-filled space at least partially separates the inner pipe and the outer pipe.

Exhaust gases from an internal combustion engine are conveyed through a plurality of such pairs of pipe members downstream to one or more exhaust pipes.

Other features and advantages of the invention will become apparent from the following detailed description, taken in conjunction with the accompanying drawings, which illustrate, by way of example, the features of the invention.

DETAILED DESCRIPTION

Both during and after operation of an engine, the side walls of a pair of pipe members within an exhaust manifold expand and contract, often rubbing or sliding against each other. This shortcoming is substantially eliminated by shaping the opposing side walls to present a concave surface with respect to each other and welding the pipe members at only two contact areas, thereby forming a gap between the side walls which extends along the length of the confronting downstream end portions of the pipe members. Such a concave shape of each side wall allows each section to expand in the same direction and also to expand away from each other so that the side walls can expand and contract evenly along their length while heating and cooling. Further, the gap ensures that the side walls will not contact each other when they contract back to their original position.

Figure 1:
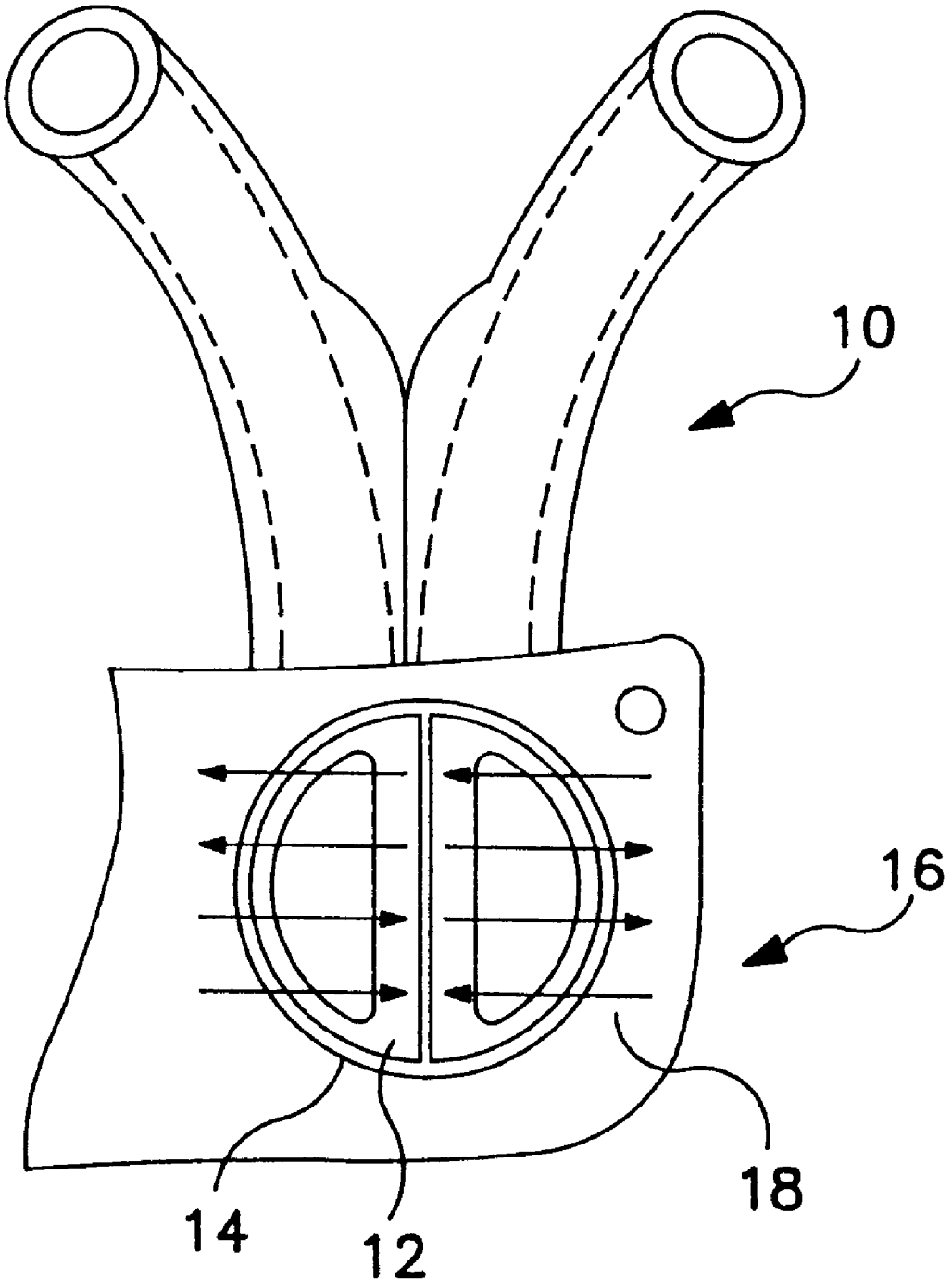
FIG. 1 PRIOR ART
FIG. 1 is an elevational view of a pair of abutting D-shaped pipe members.
Figure 2:
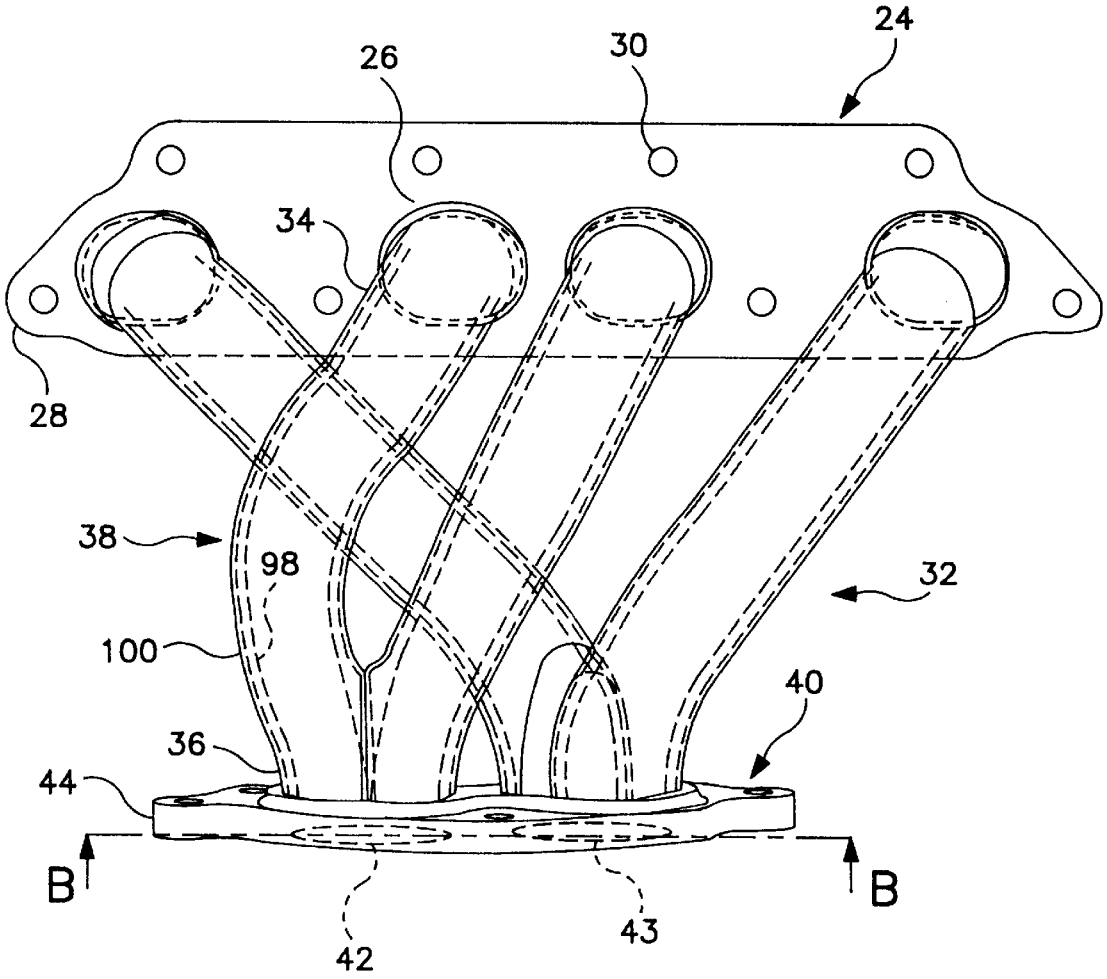
FIG. 2 is a perspective view of an exhaust manifold including a plurality of paired pipe members in accordance with the principles of the invention.

FIG. 2 is a perspective view of an exhaust manifold including a plurality of paired pipe members incorporating a weld assembly structure in accordance with the principles of the invention. The exhaust manifold shown in FIG. 2 includes an inlet flange plate 24 which is mountable on an internal combustion engine (not shown). The inlet flange plate 24 defines a plurality of apertures, or inlet openings 26, which when the flange plate 24 is coupled to the internal combustion engine correspond to the location of exhaust ports connected to cylinders of the internal combustion engine, and through which exhaust gases pass. Each inlet opening 26 defined by the inlet flange plate is associated with a respective exhaust port.

The inlet flange plate 24 presents an inlet flange 28 at the periphery of the inlet flange plate 24. The inlet flange plate 24 defines one or more bolt holes 30 through which a bolt (or other fastening means) can extend to fasten the inlet flange plate 24 to the internal combustion engine so that the inlet openings 26 of the inlet flange plate 24 are aligned with the exhaust ports of the internal combustion engine. FIG. 2 depicts an exemplary inlet flange plate 24 having four inlet openings.

The exhaust manifold shown in FIG. 2 includes a plurality of pipe members 32 downstream of and connected to the inlet flange plate 24. Each pipe member presents an upstream end portion 34 and a downstream end portion 36. In FIG. 2, the upstream end 34 of each of the four pipe members is connected to one of the inlet openings 26 so that exhaust gases pass from the respective exhaust port, through the respective inlet opening 26 into such pipe member 38. Each of the pipe members is connected, at its downstream end 36, to an outlet flange plate 40.

The outlet flange plate 40 is connectable to a number of exhaust pipes (not shown) which are downstream from the plurality of pipe members 32. The outlet flange plate 40 defines a plurality of outlet openings 42, 43, the number of which corresponds to the number of exhaust pipes. The number of outlet openings (and also the number of exhaust pipes) is half the number of pipe members according to the preferred embodiment of the invention. The outlet openings 42, 43 defined by the outlet flange plate 40 connect respective pairs of pipe members to an associated exhaust pipe, and provide a conduit through which exhaust gases pass from the pipe members to the exhaust pipes. The outlet flange plate 40 presents an outlet flange 44 along the periphery of the outlet flange plate 40. The outlet flange plate 40 defines one or more bolt holes through which a bolt or other fastening means can pass to attach and guide the outlet flange plate and the pipe members connected thereto with respect to the exhaust pipes.

Figure 3:
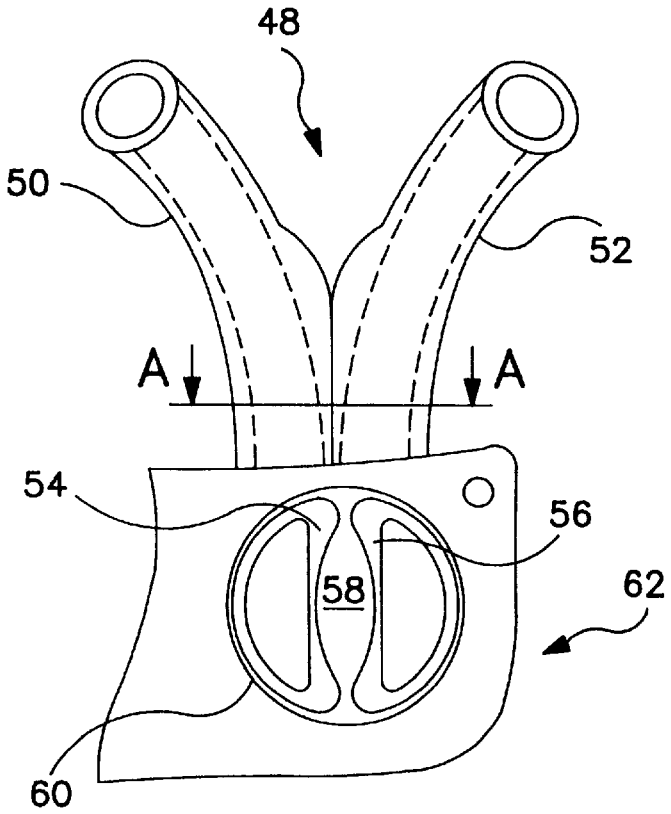
FIG. 3 is an elevational view of a pair of abutting pipe members having opposing concave side walls in accordance with the principles of the invention.

The downstream end portion 36 of each of the plurality of pipe members 32 presents a unique modified cross-sectional configuration differing from a D-shaped cross-sectional configuration. This modified cross-sectional configuration integrates a concave side wall with an outer curved portion in accordance with the principles of the invention. With reference to FIG. 3, each pair of pipe members 48 includes first and second pipe members 50, 52. Each of the first and second pipe members 50, 52 includes a side wall 54, 56. Side walls 54, 56 extend the length of the downstream end portion of the pipe members 50, 52. According to the principles of the invention, the opposing side walls 54, 56 are formed to present a concavity with respect to the opposing side wall. Such pair of opposing concave side walls 54, 56 defines a gap 58 between the opposing side walls 54, 56 extending along the length of the downstream end portion of the pipe members 50, 52.

With reference to FIG. 3, the downstream portions of the pair 48 of pipe members 50, 52 converge into the outlet opening 60 of the outlet flange plate 62. The concave side walls 54, 56 are in an opposing relationship in accordance with the principles of the invention. The opposition of the two concave side walls 54, 56 defines the gap 58 between the two concave side walls that extends along the length of the downstream end portion of the attached pipe members 50, 52. The gap 58 reduces contact between the pair of pipe members along their opposing side walls 54, 56 according to the principles of the invention.

Figure 4:
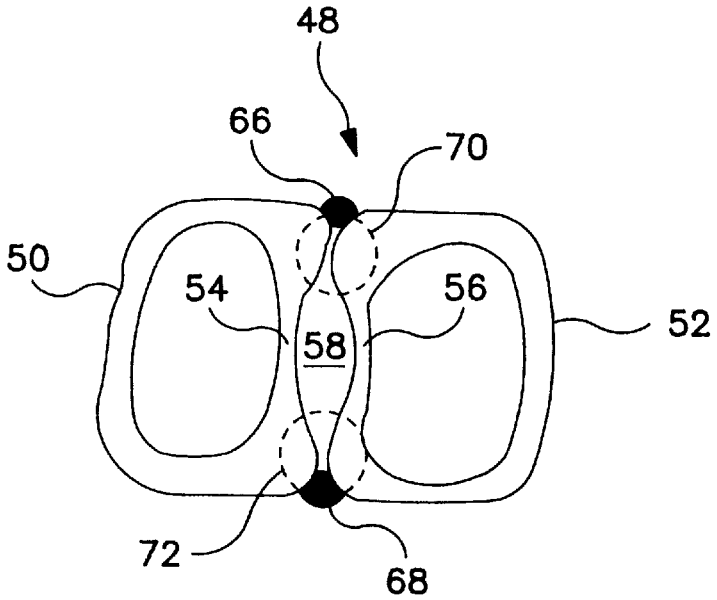
FIG. 4 is an elevational cross-sectional view taken along the line A—A in FIG. 3 of the pair of abutting pipe members.

FIG. 4 shows an elevational cross-sectional view taken along the line A—A in FIG. 3 of the pair 48 of pipe members 50, 52 welded together in accordance with the principles of the invention. Creation of the gap 58 defined between the opposing concave side walls 54, 56 along the downstream end portions of the pair of pipe members is facilitated by a welding technique in accordance with the principles of the invention. With reference to FIG. 4, two welds 66, 68 join the opposing concave side walls 54, 56 of the pair 48 of pipe members. The two pipe members are welded at an upper welding portion 70 and a lower welding portion 72. Surface contact area between the welded pair of pipe members is reduced by the formed concave shape of the side wall of each pipe member as taught herein.

Figure 5:
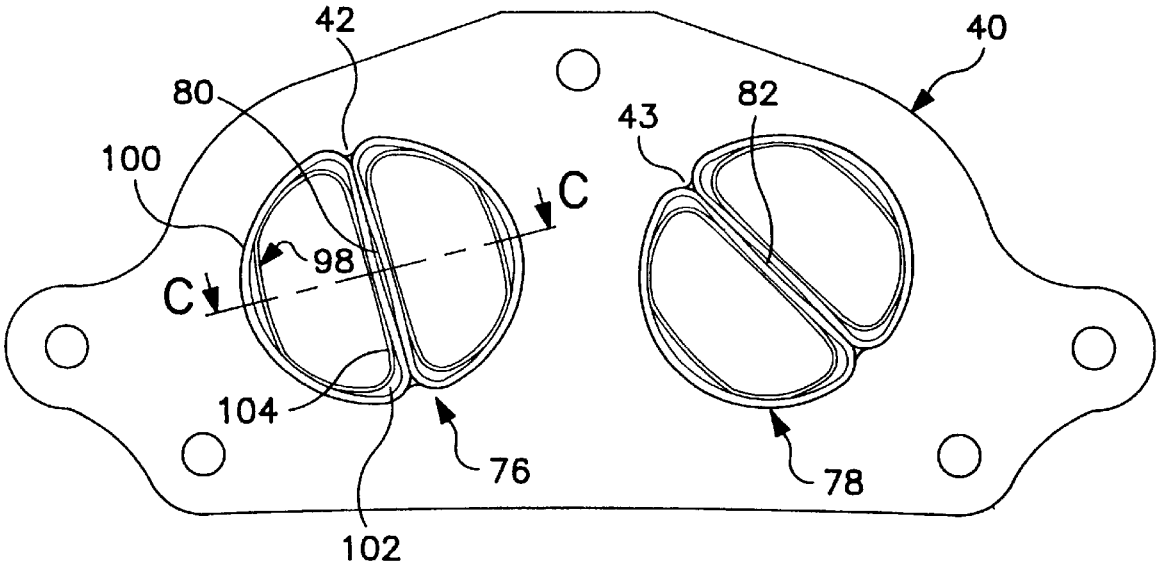
FIG. 5 is an elevational view taken along the line B—B in FIG. 2 of the downstream face of an outlet flange plate.

FIG. 5 is an elevational view taken along the line B—B of FIG. 2 of the downstream face of the outlet flange plate 40. In each of two pairs 76, 78 of pipe members, the pipe members have opposing and opposite cross-sectional configurations. Each pair 76, 78 is inserted into and held by the respective outlet opening 42, 43 defined by the outlet flange plate 40. Each pair 76, 78 defines a gap 80, 82 extending along the length of the downstream end portion of the two confronting pipe members between the opposing side walls. This gap substantially eliminates the "pings" caused by expansion and contraction of the pipe members during heating and cooling of the pipe members.

Figure 6:
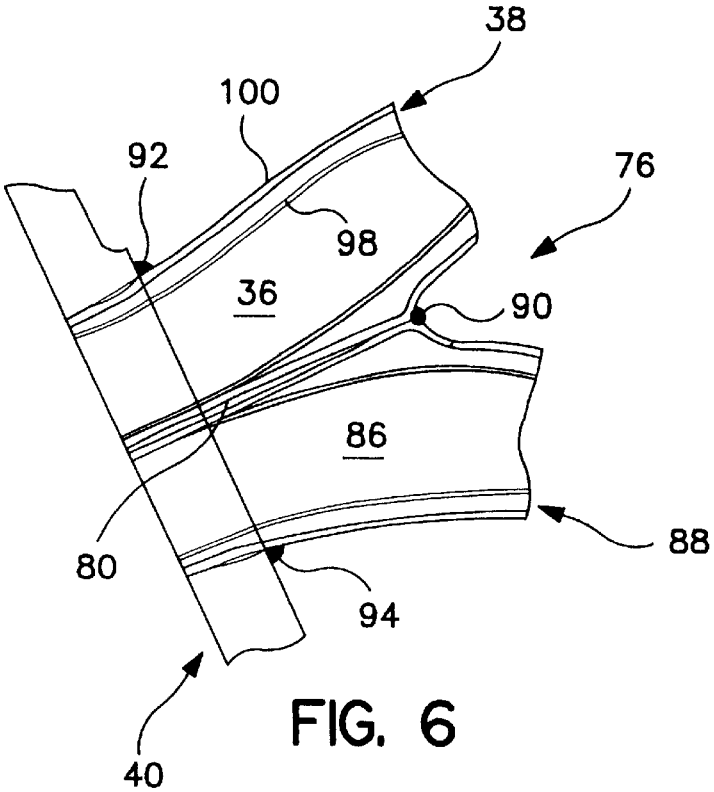
FIG. 6 is a plan cross-sectional view taken along the line C—C in FIG. 5 of the downstream end portion of a pair of pipe members.

FIG. 6 presents a plan cross-sectional view taken along the line C—C in FIG. 5 of the downstream end portion of the pair 76 of pipe members, each having a concave side wall, as inserted into the outlet opening 42 (FIG. 5) of the outlet flange plate 40 in accordance with the principles of the invention. The downstream end portions 36, 86 of the two opposing pipe members 38, 88 are configured to converge in combination in order to enter the outlet opening 42 (FIG. 5) of the outlet flange plate 40. The two opposing pipe members 38, 88 are welded together at two spots according to the principles of the invention. The upper weld 90 is illustrated in FIG. 6. The pair 76 of pipe members extends into the outlet opening 42 (FIG. 5) defined by the outlet flange plate 40 for connection to an exhaust pipe (not shown). The two confronting pipe members 38, 88 define in this position the gap 80 that reduces "pinging" sounds caused by expansion and contraction of the pipe members and further reduces wear resulting from abrasive contact between the expanding and contracting pipe members.

With reference to FIG. 6, the two pipe members 38, 88 are welded together in converging relationship to fit inside the generally cylindrical outlet opening 42 (FIG. 5) which has a substantially circular cross-sectional configuration. The two welded pipe members 38, 88 are friction-fit into place and occlude the outlet opening of the outlet flange plate 40. The joint between the outer wall of each pipe member and the upstream face of the outlet flange plate is welded (92, 94) in one or more spots or a line using a suitable welding material. The upper portion of both pipe members are welded together at upper weld 90, and a lower portion of both pipe members are welded together (not shown) at the position upstream from the outlet flange plate 40 where the pipe members 38, 88 initially contact each other.

With reference to FIG. 2, according to an aspect of the invention, each of the plurality of pipe members 32 disposed between the inlet flange plate 24 and the outlet flange plate 40 connecting the cylinder exhaust ports and the exhaust pipes includes an inner pipe and an outer pipe. The pipe member 38 comprises an inner pipe 98 located within an outer pipe 100. One or more portions of the inner pipe are in contact with the outer pipe.

With reference to FIG. 5, the inner pipe 98 abuts the outer pipe 100 at three contact areas that are spaced from each other on the outer pipe to optimally support the outer pipe 100. Employing three contact areas between the inner pipe 98 and the outer pipe 100 optimally balances the competing considerations of supporting the outer pipe 100, yet also allowing the inner pipe 98 to heat quickly during engine start up so that downstream from the engine, exhaust gases are maintained at a sufficiently hot temperature to successfully interact with a downstream catalytic converter.

With continuing reference to FIG. 5, the air-filled space 102 between the pipes according to the principles of the invention creates an effective thermal insulator to prevent heat from dissipating to the outer pipe 100, while the inner pipe 98 is still adequately protected. Such insulation of the inner pipe 98 produces a faster light off of the catalytic converter (i.e., attaining an acceptable working temperature range) so it can reduce harmful exhaust gas emissions. In addition, since the outer pipe is a structural element that holds the manifold together, the air-filled space helps to reduce the temperature on the outer pipe which improves its durability. Also, thermal expansion of the inner pipe 98 can occur in the spaces 102 between the inner and outer pipes without contacting or rubbing of the pipes. Thus, the possibility of outer pipe breakage caused by the thermal expansion of the inner pipe 98 is reduced. The outer pipe 100 circumscribing the inner pipe 98 protects the inner pipe from dirt, debris and corrosive elements. The outer pipe 100 helps to reduce objectionable noise emissions, functioning as an additional muffler or silencer.

With reference to FIG. 2, the downstream end portions of the plurality of pipe members 32 converge into pairs of pipe members. Each pair extends through cylindrically-shaped outlet openings in the outlet flange plate 40 to discharge exhaust gases into an exhaust pipe (not shown). Insertion and passage of each pair of pipe members through the outlet opening, which has a substantially circular cross-sectional configuration, is facilitated by the cross-sectional configurations of each of the pipe members that integrate the concave-shaped side walls taught herein. The opposing cross-sectional configurations cooperate to form a combined cross-sectional shape that will fit through an outlet port that has a substantially circular cross-sectional configuration.

With reference to FIG. 5, at the downstream end portion of each pair of pipe members, the outer pipes 100 present the side walls that are concave in shape with respect to each other in accordance with the principles of the invention, making the gap 80 between the opposing side walls of the outer pipes. The inner pipe 98 disposed within the outer pipe of each pipe member presents a cross-sectional configuration that can be accommodated within the outer pipe 100, thus presenting an inner concave wall 104, and the inner pipe 98 preferably contacts the outer pipe at three contact areas that are spaced apart and extend along the downstream end portion of the outer pipe 100.

With reference to FIG. 6, the upper portion of the opposing side walls of the outer pipe 100 are welded to each other at an upper welding point 90, while lower portions of the opposing side walls of the outer pipe 100 are welded to each other at a lower welding point (not shown).

The pipe members are preferably made of stainless steel. In the preferred embodiment of the invention, the thickness of the outer pipe 100 is about 1.4 mm and the thickness of the inner pipe 98 is about 0.6 mm. Preferably, the gap is about 1.0 mm wide at its widest point.

Figure 7:
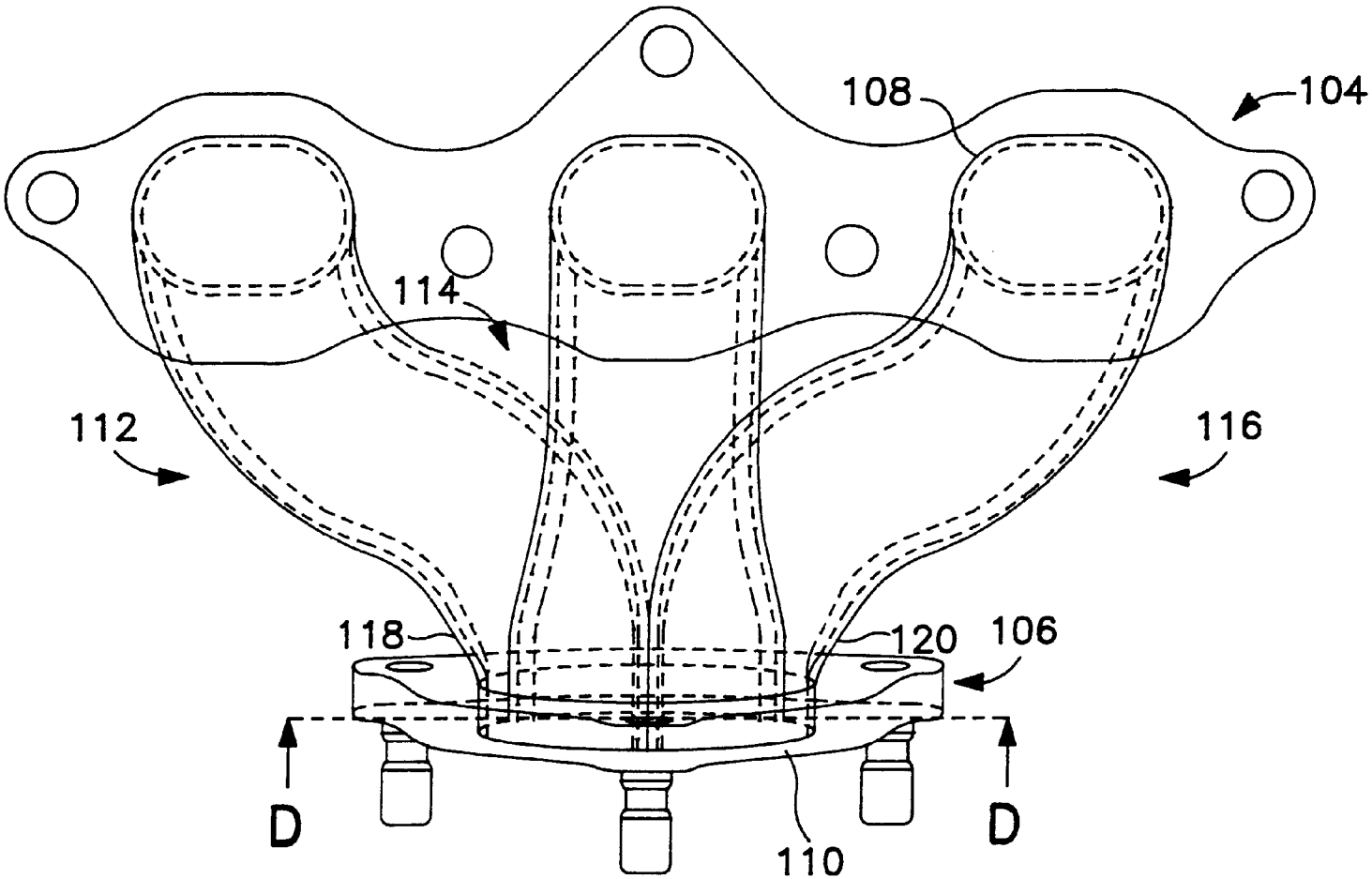
FIG. 7 is a perspective view of an exhaust manifold having three pipe members extending into an outlet flange plate in accordance with the principles of the invention.
Figure 8:
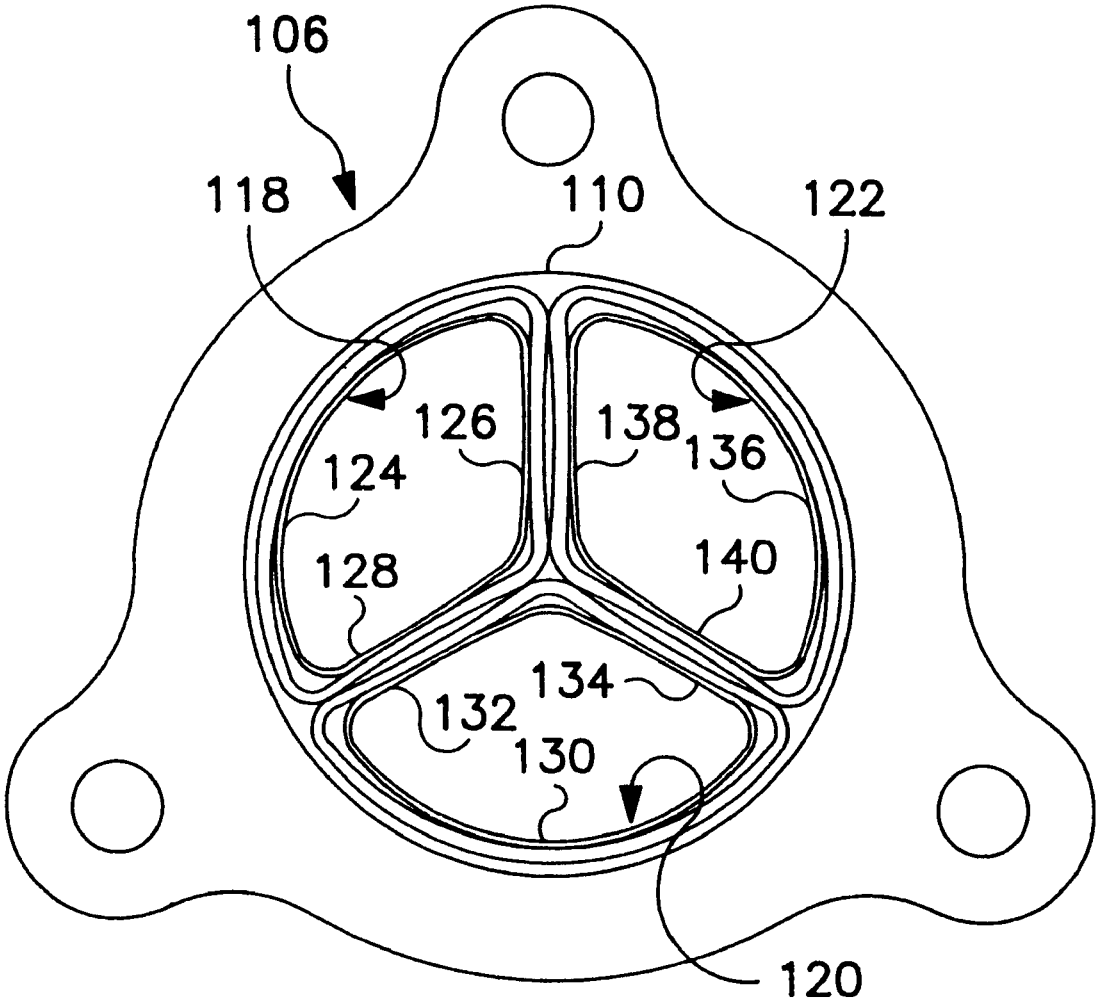
FIG. 8 is an elevational view taken along the line D—D in FIG. 7 of the downstream face of the outlet flange plate.

FIGS. 7 and 8 illustrate another embodiment of the invention, in which an exhaust manifold for an internal combustion engine having a plurality of cylinders includes three pipe members that extend into the opening of an outlet flange plate in accordance with the principles of the invention. The exhaust manifold shown in FIG. 7 includes an inlet flange plate 104 and an outlet flange plate 106 downstream of the inlet flange plate 104. The inlet flange plate 104 defines three inlet openings 108 through which exhaust gases can pass from the cylinder exhaust ports. The outlet flange plate 106 defines an outlet opening 110 which communicates exhaust gas into an exhaust pipe (not shown) downstream of the outlet flange plate 106. A first pipe member 112, a second pipe member 114 and a third pipe member 116 are each received into a respective inlet opening of the inlet flange plate 104.

FIG. 8 is an elevational view taken along the line D—D of FIG. 7 of the downstream face of the outlet flange plate 106. With reference to FIG. 8, the first pipe member 112 (FIG. 7) has a first downstream end portion 118. The second pipe member 114 (FIG. 7) has a second downstream end portion 120. The third pipe member 116 (FIG. 7) has a third downstream end portion 122. The first downstream end portion 118, the second downstream end portion 120 and the third downstream end portion 122 have a combined cross-sectional configuration that fits into the outlet port 110 of the outlet flange plate 106, which has a substantially circular cross-sectional configuration. The first downstream end portion 118, the second downstream end portion 120 and the third downstream end portion 122 converge together and extend into the outlet port 110.

With reference to FIG. 8, the downstream end portion of each pipe member has two concave-shaped side walls, and each side wall opposes a side wall of another pipe member according to the principles of the invention. The first downstream end portion 118 presents a first perimeter wall 124 and a first pair of concave-shaped interior side walls 126, 128. The second downstream end portion 120 presents a second perimeter wall 130 and a second pair of concave-shaped interior side walls 132, 134. The third downstream end portion 122 presents a third perimeter wall 136 and a third pair of concave-shaped interior side walls 138, 140.

According to the illustrative embodiment of the invention described with reference to FIG. 8, each side wall of one pipe member is in opposing relation with, and concave with respect to, a side wall of another pipe member. A gap is defined by each pair of opposing concave side walls in which the opposing side walls expand and contract while heating and cooling.

Figure 9:
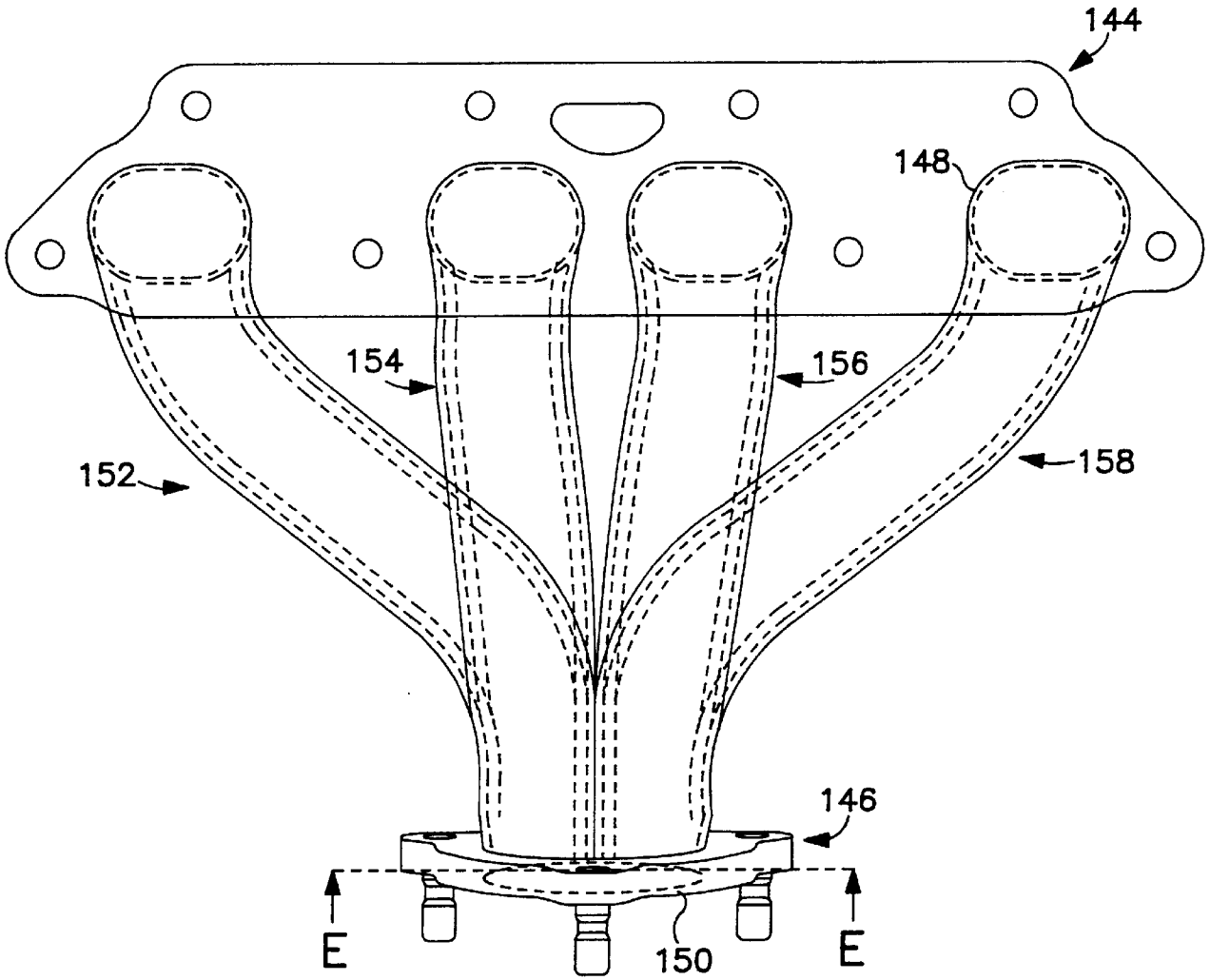
FIG. 9 is a perspective view of an exhaust manifold having four pipe members extending into an outlet flange plate in accordance with the principles of the invention.
Figure 10:
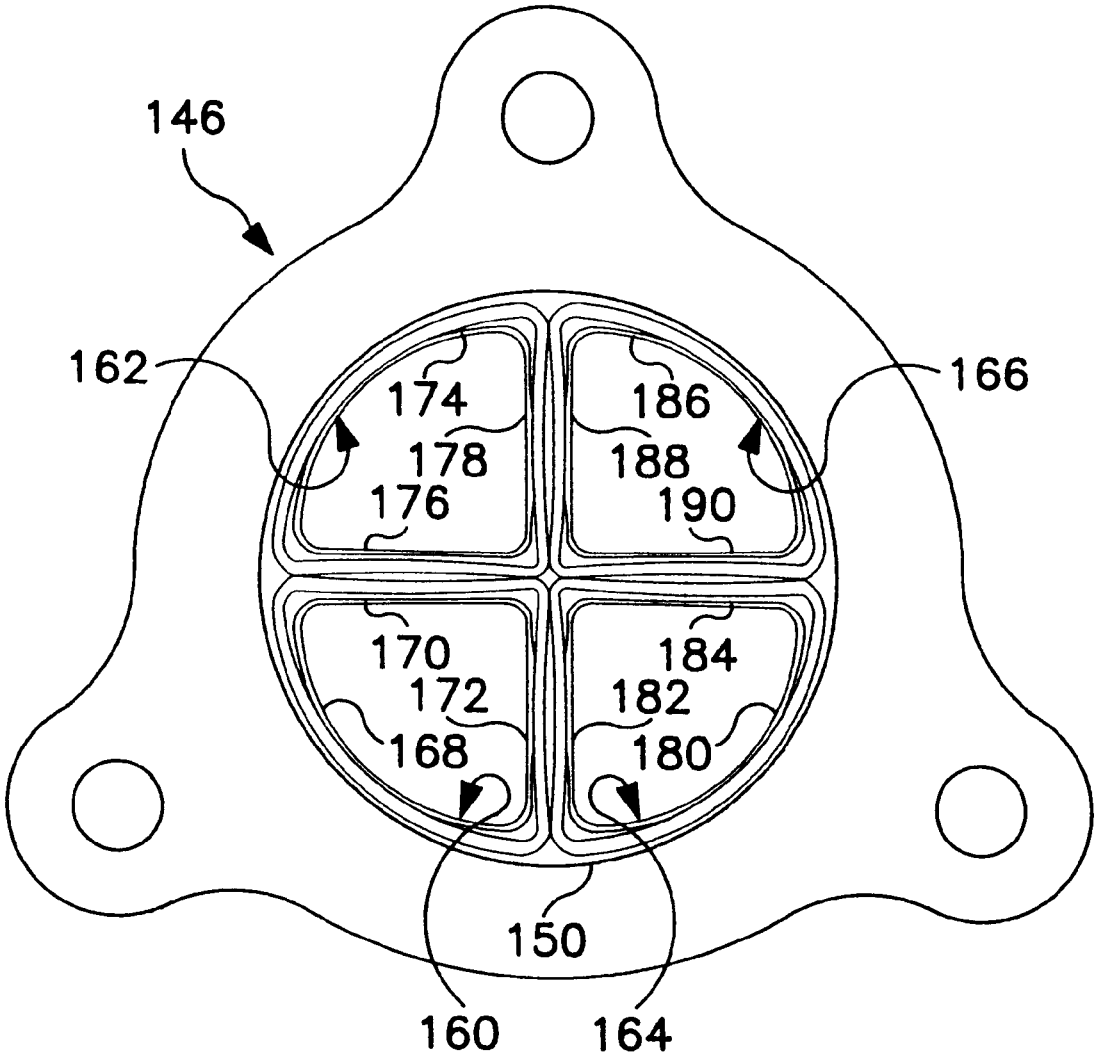
FIG. 10 is a elevational view taken along the line E—E in FIG. 9 of the downstream face of the outlet flange plate.

FIGS. 9 and 10 illustrate another exemplary embodiment of the invention, in which an exhaust manifold for an internal combustion engine having a plurality of cylinders includes four pipe members that extend into an opening of an outlet flange plate. The exhaust manifold depicted in FIG. 9 includes an inlet flange plate 144 and an outlet flange plate 146 downstream of the inlet flange plate 144. The inlet flange plate 144 defines four inlet openings 148 through which exhaust gases can pass. The outlet flange plate 146 defines an outlet opening 150 which communicates exhaust gas into an exhaust pipe (not shown) downstream of the outlet flange plate 146. A first pipe member 152, a second pipe member 154, a third pipe member 156 and a fourth pipe member 158 are each coupled to a respective inlet opening of the inlet flange plate 144.

FIG. 10 is an elevational view taken along the line E—E of FIG. 9 of the downstream face of the outlet flange plate 146. With reference to FIG. 10, the first pipe member 152 (FIG. 9) has a first downstream end portion 160. The second pipe member 154 (FIG. 9) has a second downstream end portion 162. The third pipe member 156 (FIG. 9) has a third downstream end portion 164. The fourth pipe member 158 (FIG. 9) has a fourth downstream end portion 166.

The downstream end portions of the four pipe members have a combined cross-sectional configuration that can fit into an outlet port having a substantially circular cross-sectional configuration. The first downstream end portion 160, the second downstream end portion 162, the third downstream end portion 164 and the fourth downstream end portion 166 converge together to enter the outlet port 150. The first downstream end portion 160, the second downstream end portion 162, the third downstream end portion 164 and the fourth downstream end portion 166 extend into the outlet port 150 of the outlet flange plate 146.

As depicted in FIG. 10, each downstream end portion presents two concave-shaped side walls, where each side wall opposes a side wall of another downstream end portion according to the principles of the invention. With reference to FIG. 10, the first downstream end portion 160 presents a first perimeter wall 168 and a first pair of concave-shaped interior side walls 170, 172. The second downstream end portion 162 presents a second perimeter wall 174 and a second pair of concave-shaped interior side walls 176, 178. The third downstream end portion 164 presents a third perimeter wall 180 and a third pair of concave-shaped interior side walls 182, 184. The fourth downstream end portion 166 presents a fourth perimeter wall 186 and a fourth pair of concave-shaped interior side walls 188, 190.

Each side wall presented by one downstream end portion is in opposing relation with, and concave with respect to, a side wall of another downstream end portion. A gap is defined between each pair of opposing concave side walls in which the opposing side walls expand and contract while heating and cooling.

When exhaust gases from an internal combustion engine are conveyed through one or more of the pairs of pipe members taught herein to one or more exhaust pipes downstream, the side walls are able to expand and contract in the gap.

From the foregoing, it will be appreciated that the welded assembly of the concave opposing side walls of the pair of pipe members in accordance with the principles of the invention more evenly distributes thermal stresses throughout the length of the pipe members by allowing the side walls to expand and contract evenly along their length. The inner pipe contacts the surrounding outer pipe at three contact areas to support the outer pipe and allow the inner pipe to more easily expand within the outer pipe when heated.

While several particular forms of the invention have been illustrated and described, it will also be apparent that various modifications can be made without departing from the spirit and scope of the invention.

What is claimed is:

1. An exhaust manifold for an internal combustion engine having a plurality of cylinders, comprising:

a first pipe member;

a second pipe member;

the first pipe member having a first downstream end portion, and including along the first downstream end portion thereof a first side wall;

the second pipe member having a second downstream end portion, and including along the second downstream end portion thereof a second side wall;

the first side wall is in opposing relation with, and concave with respect to, the second side wall;

the second side wall is in opposing relation with, and concave with respect to, the first side wall; and a gap defined by the opposing concave first side wall and second side wall in which the first side wall and the second side wall expand and contract while heating and cooling.

2. The exhaust manifold of claim 1, wherein:

the first downstream end portion and the second downstream end portion are joined at only two contacting areas.

3. The exhaust manifold of claim 1, wherein:

the first side wall and the second side wall each include an upper portion and a lower portion; and further comprising an upper weld joining the upper portion of both the first side wall and the second side wall; and a lower weld joining the lower portion of both the first side wall and the second side wall.

4. The exhaust manifold of claim 1, wherein:

the first downstream end portion and the second downstream end portion converge toward each other.

5. The exhaust manifold of claim 1, wherein:

each of the first pipe member and the second pipe member has an upstream end portion connected to the plurality of cylinders.

6. The exhaust manifold of claim 1, wherein:

each of the first downstream end portion and the second downstream end portion is connected to an exhaust pipe.

7. The exhaust manifold of claim 1, wherein:

the gap extends the length of the first downstream end portion and the second downstream end portion.

8. The exhaust manifold of claim 1, wherein:

the first downstream end portion and the second downstream end portion have a combined cross-sectional shape that fits into an outlet port having a substantially circular cross-sectional configuration.

9. An exhaust manifold for an internal combustion engine having a plurality of cylinders, comprising:

a first pipe member;

a second pipe member;

the first pipe member having a first downstream end portion and including a first outer pipe and a first inner pipe disposed within the first outer pipe;

the second pipe member having a second downstream end portion and including a second outer pipe and a second inner pipe disposed within the second outer pipe;

the first downstream end portion presenting a first side wall;

the second downstream end portion presenting a second side wall;

the second side wall is in opposing relation with, and concave with respect to, the first side wall; and a gap defined by the opposing concave first side wall and second side wall in which the first side wall and the second side wall expand and contract while heating and cooling;

the first inner pipe contacts the first outer pipe at three contacting areas that are spaced from each other on the first outer pipe; and the second inner pipe contacts the second outer pipe at three contacting areas that are spaced from each other on the second outer pipe.

10. The exhaust manifold of claim 9, wherein:

each of the first side wall and the second side wall includes an upper portion and a lower portion; and further comprising an upper weld joining the upper portion of both the first side wall and the second side wall; and a lower weld joining the lower portion of both the first side wall and the second side wall.

11. The exhaust manifold of claim 9, wherein:

the first downstream end portion and the second downstream end portion converge toward each other and are attached to each other.

12. The exhaust manifold of claim 10, wherein:

the first pipe member and the second pipe member are joined at only two contacting areas.

13. The exhaust manifold of claim 10, wherein:

each of the first pipe member and the second pipe member has an upstream end portion connected to the plurality of cylinders.

14. The exhaust manifold of claim 10, wherein:

the first downstream end portion and the second downstream end portion are each connected to an exhaust pipe.

15. The exhaust manifold of claim 10, wherein:

the gap extends the length of the first downstream end portion and the second downstream end portion.

16. The exhaust manifold of claim 9, wherein:

the first downstream end portion and the second downstream end portion have a combined cross-sectional shape that fits into an outlet port having a substantially circular cross-sectional configuration.

17. The exhaust manifold of claim 10, further comprising:

a first air-filled space at least partially separating the first inner pipe and the first outer pipe; and a second air-filled space at least partially separating the second inner pipe and the second outer pipe.

18. An exhaust manifold for an internal combustion engine having a plurality of cylinders, comprising:

a first pipe member;

a second pipe member;

the first pipe member having a first downstream end portion, and including along the first downstream end portion thereof a first side wall;

the second pipe member having a second downstream end portion, and including along the second downstream end portion thereof a second side wall; and means for reducing contact between the first side wall and the second side wall during heating and cooling of the first pipe member and the second pipe members;

the first side wall and the second side wall expand and contract within the means for reducing contact.

19. The exhaust manifold of claim 18, wherein:

the first side wall and the second side wall are in opposing relation.

20. The exhaust manifold of claim 18, further comprising:

means for joining the first side wall and the second side wall in opposing relation.

21. An exhaust manifold for an internal combustion engine having a plurality of cylinders, comprising:

a first pipe member;

a second pipe member;

a third pipe member;

the first pipe member having a first downstream end portion, and including along the first downstream end portion thereof at least a pair of side walls;

the second pipe member having a second downstream end portion, and including along the second downstream end portion thereof at least a pair of side walls;

the third pipe member having a third downstream end portion, and including along the third downstream end portion thereof at least a pair of side walls;

each side wall of one pipe member is in opposing relation with, and concave with respect to, a side wall of another pipe member; and a gap defined by the opposing concave side walls in which the side walls expand and contract while heating and cooling.

22. The exhaust manifold of claim 21, further comprising:

a fourth pipe member having a fourth downstream end portion, and including along the fourth downstream end portion thereof at least a pair of side walls.

* * * * *